US005863860A

United States Patent [19]

Patel et al.

[11] Patent Number: 5,863,860

[45] **Date of Patent: *Jan. 26, 1999**

[54] THERMAL TRANSFER IMAGING

[75] Inventors: Ranjan C. Patel, Little Halingbury, Great Britain; Hsin-Hsin Chou; Kam K. Kam, both of Woodbury, Minn.

[73] Assignee: Minnesota Mining and Manufacturing Company, St. Paul, Minn.

[ * ] Notice: The term of this patent shall not extend beyond the expiration date of Pat. No. 5,437,912.

[21] Appl. No.: 769,099

[22] Filed: Dec. 18, 1996

Related U.S. Application Data

[63] Continuation of Ser. No. 374,791, filed as PCT/GB92/01489, Dec. 8, 1992, published as WO94/4368, Mar. 3, 1994., abandoned.

[51] Int. Cl.[6] ..... B41M 5/035; B41M 5/38

[52] U.S. Cl. ..... 503/227; 427/146; 427/248.1; 427/255.6; 428/195; 428/913; 428/914; 430/5; 430/200; 430/201

[58] Field of Search ..... 8/471; 428/195, 428/913, 914; 503/227; 427/147, 248.1, 255.6; 430/200, 201, 5

[56] References Cited

U.S. PATENT DOCUMENTS

| | | | |
|---|---|---|---|
| 3,787,210 | 1/1974 | Roberts | 96/27 E |
| 3,811,884 | 5/1974 | Inoue et al. | 96/27 |
| 3,822,122 | 7/1974 | Plumat et al. | 65/30 |
| 3,828,359 | 8/1974 | Vogelgesang et al. | 95/85 |
| 3,946,389 | 3/1976 | Haböck et al. | 343/225 |
| 4,123,309 | 10/1978 | Perrington et al. | 156/234 |
| 4,123,578 | 10/1978 | Perrington et al. | 428/206 |
| 4,157,412 | 6/1979 | Deneau | 428/147 |
| 4,271,256 | 6/1981 | Kido et al. | 430/253 |
| 4,364,995 | 12/1982 | Crawford et al. | 428/336 |
| 4,430,366 | 2/1984 | Crawford et al. | 427/167 |
| 4,541,830 | 9/1985 | Hotta et al. | 8/471 |
| 4,587,198 | 5/1986 | Fisch | 430/201 |
| 4,599,218 | 7/1986 | Demaison et al. | 422/61 |
| 4,599,298 | 7/1986 | Fisch | 430/271 |
| 4,602,263 | 7/1986 | Borrer et al. | 346/201 |
| 4,657,840 | 4/1987 | Fisch | 430/201 |
| 4,788,128 | 11/1988 | Barlow | 430/200 |
| 4,857,503 | 8/1989 | Jongewaard et al. | 503/227 |
| 4,875,961 | 10/1989 | Oike et al. | 156/234 |
| 4,892,602 | 1/1990 | Oike et al. | 156/233 |
| 4,904,572 | 2/1990 | Dombrowski, Jr. et al. | 430/332 |
| 4,912,083 | 3/1990 | Chapman et al. | 503/227 |
| 4,923,860 | 5/1990 | Simons | 503/227 |
| 4,942,141 | 7/1990 | DeBoer et al. | 503/227 |
| 4,948,776 | 8/1990 | Evans et al. | 503/227 |
| 4,948,777 | 8/1990 | Evans et al. | 503/227 |
| 4,948,778 | 8/1990 | DeBoer | 503/227 |
| 4,950,639 | 8/1990 | DeBoer et al. | 503/227 |
| 4,950,640 | 8/1990 | Evans et al. | 503/227 |
| 4,952,552 | 8/1990 | Chapman et al. | 503/227 |
| 4,973,572 | 11/1990 | DeBoer | 503/227 |
| 5,019,549 | 5/1991 | Kellog et al. | 503/227 |
| 5,024,990 | 6/1991 | Chapman et al. | 503/227 |
| 5,079,128 | 1/1992 | Katagiri et al. | 430/269 |
| 5,139,598 | 8/1992 | Chou et al. | 156/234 |
| 5,190,849 | 3/1993 | Santoh et al. | 430/495 |
| 5,236,739 | 8/1993 | Chou et al. | 427/146 |
| 5,380,607 | 1/1995 | Van Haute et al. | 430/3 |
| 5,437,912 | 8/1995 | Chou et al. | 428/195 |

FOREIGN PATENT DOCUMENTS

| | | | |
|---|---|---|---|
| 0125086 | 11/1984 | European Pat. Off. . | |
| 0312923 | 4/1989 | European Pat. Off. . | |
| 0365222 | 4/1990 | European Pat. Off. . | |
| 0403931 | 12/1990 | European Pat. Off. . | |
| 0403932 | 12/1990 | European Pat. Off. . | |
| 0403933 | 12/1990 | European Pat. Off. . | |
| 0403934 | 12/1990 | European Pat. Off. . | |
| 0404042 | 12/1990 | European Pat. Off. . | |
| 0405219 | 1/1991 | European Pat. Off. . | |
| 0405296 | 1/1991 | European Pat. Off. . | |
| 0407744 | 1/1991 | European Pat. Off. . | |
| 0408891 | 1/1991 | European Pat. Off. . | |
| 0408907 | 1/1991 | European Pat. Off. . | |
| 0408908 | 1/1991 | European Pat. Off. . | |
| 0 454 083 A2 | 10/1991 | European Pat. Off. | 503/227 |
| 91311759 A | 12/1991 | European Pat. Off. | 503/227 |
| 403930 | 2/1994 | European Pat. Off. | 503/227 |
| 51-088016 | 8/1976 | Japan . | |
| 63-319192 A | 12/1988 | Japan | 428/195 |
| 63-319191 | 12/1989 | Japan . | |
| 2175292 A | 7/1990 | Japan | 503/227 |
| 3043294 A | 2/1991 | Japan | 430/945 |
| 1385533 | 2/1975 | United Kingdom | 430/945 |
| 1433025 | 4/1976 | United Kingdom | 503/227 |
| 2083726 | 3/1982 | United Kingdom | 503/227 |
| 568267 | 11/1993 | United Kingdom | 503/227 |

OTHER PUBLICATIONS

Research Disclosure No. 14223, "Flash dye transfer", Feb. 1976.

Translation of Japanese Patent Application No. 2–279580 filed Oct. 17, 1990 by Konica Corp. relating to "An Image Receiving Material for Use in Thermal Transfer, a Transfer Method, and a Method for Producing a Printing Proof Plate."

*Primary Examiner*—Bruce H. Hess

[57] ABSTRACT

A method comprising the following steps:

(a) creating a thermal transfer donor sheet by vapor depositing a colorant layer onto a support;

(b) contacting a receptor sheet with the donor sheet such that the colorant layer is in intimate contact with the receptor sheet, wherein at least one of the donor and receptor sheets comprises a radiation-absorbing material;

(b) imagewise exposing the contacted sheets to radiation of a wavelength absorbed by the radiation-absorbing material, thereby causing heating in the exposed regions, said heating causing thermal transfer of colorant from the donor sheet to the receptor sheet in an imagewise fashion.

12 Claims, No Drawings

THERMAL TRANSFER IMAGING

This is a continuation of application Ser. No. 08/374,791 filed as PCT/GB92/01489, published as WO94/4368 Mar. 3, 1994, now abandoned.

The present invention relates to a method of thermal transfer imaging, in which a scanning exposure source, such as a laser, is used to effect the thermal transfer of colourant from a donor sheet to a receptor for the thermally transferred colourant.

Thermal transfer imaging involves the imagewise transfer of colourant from a donor sheet to a receptor sheet under the action of heat, the donor and receptor sheets being maintained in intimate, face-to-face contact throughout. This type of imaging is increasingly popular, mainly because it is "dry" (requiring no chemical development) and therefore compatible with the home or office environment.

The heat required to effect transfer of the colourant is usually supplied by contacting the assembled (but not bonded) donor and receptor sheets with so called "thermal printheads" comprising arrays of miniature electrically-heated elements, each of which is capable of being activated in a timed sequence to provide the desired imagewise pattern of heating. However, such systems provide rather poor resolution and increasing interest is being shown in the use of radiant or projected energy, especially infrared radiation, to supply the heat, thereby taking advantage of the greater commercial availability of laser diodes emitting in the near-infrared region. This is achieved by incorporating a radiation-absorbing material in one of the donor and receptor sheets, normally the former, and subjecting the assembled sheets to an imagewise pattern of radiation. When the assembled sheets are irradiated by radiation of an appropriate wavelength, then the radiation-absorbing material converts the incident energy to thermal energy and transfers heat to the colourant in its immediate vicinity, causing imagewise transfer of the colourant to the receptor.

Examples of thermal transfer media include those disclosed in British Patent No. 1385533; British Patent Publication No. 2083726; European Patent Publication Nos. 403932, 403933, 403934, 404042, 405219, 405296, 407744, 408891, 407907 and 408908; U.S. Pat. Nos. 3,787,210, 3,946,389, 4,541,830, 4,602,263, 4,788,128, 4,904,572, 4,912,083, 4,942,141, 4,948,776, 4,948,777, 4,948,778, 4,950,639, 4,950,640, 4,952,552 and 4,973,572; International Patent Publication No. PCT WO88/04237; Japanese Patent Publication Nos. 21-075292 and 30-043294, and Japanese Patent Nos. 51-088016, 56-082293, 63-319191 and 63-319192.

In the majority of conventional systems using radiant or projected energy to effect the thermal transfer of colourant, the donor sheet comprises a support bearing a donor layer containing the colourant, ordinarily dissolved or dispersed in a binder, with the radiation-absorbing material incorporated in either the same layer as the colourant, e.g., as disclosed in European patent Publication No. 403933, or in a separate underlayer interposed between the support and donor layer, e.g., as disclosed in Japanese Patent No. 63-319191. The donor sheet may be of the diffusion-transfer type (sometimes referred to as "sublimation-transfer" materials), whereby colourant is transferred to the receptor in an amount proportional to the intensity of radiation absorbed, or the mass-transfer type, whereby either 0 (zero) or 100% transfer of colourant takes place, depending on whether the absorbed energy reaches a threshold value. In mass-transfer materials, both the colourant and binder are transferred to the receptor sheet.

Two distinct methods are known in which radiation is used to effect thermal transfer of a colourant. In the first method, a laser is scanned directly over the assembled donor and receptor sheets, while its intensity is modulated in accordance with digitally stored image information. This method is disclosed in, e.g.: Research Disclosure No. 142223 (February 1976); Japanese Patent No. 51-88016; U.S. Pat. No. 4,973,572; British Patent No. 1433025, and British Patent Publication No. 2083726.

The second method involves flood exposure from a momentary source, such as a xenon flash lamp, through a suitable mask held in contact with the assembled donor and receptor sheets. This method is disclosed in, e.g: Research Disclosure No. 142223 (February 1976); U.S. Pat. Nos. 3,828,359, 4,123,309, 4,123,578 and 4,157,412, and European Patent Publication No. 365222.

U.S. Pat. Nos. 4,123,309, 4,123,578 and 4,147,412 disclose a composite strip material for use in the preparation of art graphics and the like comprising (a) an accepting tape having a layer of a latent adhesive material and (b) a transfer tape having a donor web carrying a lightly adhered layer of microgranules in face-to-face contact with the adhesive layer. At least one of the microgranule and adhesive layers bears a radiation-absorbing pigment. Upon momentary exposure to a pattern of radiation, the pigment is selectively heated, momentarily softening the adjacent portions of the adhesive layer which, upon solidification, adhere to the microgranules. The accepting and transfer tapes are then separated, with the transferring microgranules adhering to the accepting tape only in the irradiated areas.

The pigment is preferably incorporated into the microgranule-containing layer of the transfer tape, thereby providing a direct conductive path to the surface of the adhesive layer. The pigment also serves as a colouring material for the microgranules, with dark coloured microgranules giving dark graphics. Where graphics of a light colour are desired, microgranules of that light color may be used in combination with an accepting tape which comprises a receiving web, a coating of pigment on the receiving web, and a thin layer of adhesive material adhered to the pigment coating. No advantage is taught for placing the pigment in the acceptor sheet (other than the visibility of light coloured graphics) and indeed this is said to cause a drop in sensitivity.

A xenon flash lamp which produces broad spectrum bluish-white light in a flash is the preferred exposure source, with the desired imagewise pattern of radiation provided by exposing the composite strip material through a mask bearing image information. However, there are several disadvantages associated with this method of imaging. Xenon flash lamps tend to be bulky, have high power consumption and pose heat dissipation problems, but more importantly, it is very difficult in practice, to obtain large area images of high quality by this method without damaging the mask bearing the image information. This is because, under normal circumstances, the opaque areas of the mask are themselves absorbing and, since the entire area of the mask is illuminated, a large amount of energy is absorbed by the mask with no means by which it can be dissipated quickly. Consequently, high temperatures are generated within the mask, leading to melting or distortion. As the energy absorbed is proportional to the area exposed, the problem becomes more acute with larger-sized images.

In addition, because a xenon lamp is a broad band emitter, the use of a xenon flash exposure generally necessitates the use of carbon black and other materials having a similarly broad absorption as the radiation-absorber, in order to make effective use of the available energy. However, the current trend is to substitute infrared-absorbing dyes for carbon black in pursuit of higher resolution, and also in order to reduce the likelihood of image contamination by the radiation-absorber, e.g., as disclosed in European Patent Publication Nos. 312923, 403930, 403931, 403932, 403933, 403934, 404042, 405219, 405296, 407744, 408891, 408907 and 408908. Since dyes have a relatively narrow absorption band, higher intensity xenon flashes are required, which compounds the heat-distortion problem described earlier.

Japanese Patent No. 3-043294 discloses the use of an infrared-absorbing material in a separate sheet which is held in face-to-face contact with a heat-sensitive medium, but there is no disclosure of thermal transfer as described herein.

Thermal transfer donor sheets comprising a layer of an organic or inorganic colourant vapor-deposited on a controlled-release layer are disclosed, respectively, in U.S. Pat. Nos. 5,139,598 and 5,437,912, filed Oct. 11$^{th}$, 1991. Only thermal printhead, imaging is taught in connection with these materials.

U.S. Pat. Nos. 4,599,298 and 4,657,840 disclose radiation sensitive imaging materials comprising (sequentially): (i) a support, (ii) a vapor-deposited colourant layer, and (iii) a vapor-deposited layer of a metal, metal oxide or metal sulphide. Layer (iii) may be ablated imagewise using a laser, and the exposed areas of layer (ii) may be transferred to a receptor by application of heat, e.g., by direct contact with a heated platen or roller.

European Patent Publication No. 125086 discloses photoresistive elements comprising (sequentially): (i) a support, (ii) a vapor-deposited colourant layer, and (iii) a photoresist overlayer. The imagewise exposed elements are subjected to a development step to remove the resist layer in either the exposed or unexposed regions of the element, depending on whether the resist material is positive or negative-acting, and uniformly heated, e.g., by direct contact with a heated platen, to effect the selective transfer of the colourant. A receptor may receive the transferred colourant or the element with the dye selectively removed can be used as the final image. The colourant can also be transferred without development where the permeability of the reciever layer to the colourant is changed on exposure.

The present invention seeks to provide alternative thermal transfer methods and thermal transfer materials.

According to one aspect of the present invention, there is provided a method of thermal transfer imaging which comprises the following steps:

(a) contacting a receptor sheet and a donor sheet having a donor layer comprising a thermally transferable colourant such that the donor layer is in intimate contact with the receptor sheet, one of the donor and receptor sheets comprising a radiation-absorbing material capable of absorbing radiation from an exposure source such that imagewise exposure of the contacted sheets causes heating in the exposed regions, said heating causing thermal transfer of colourant from the donor sheet to the receptor sheet in an imagewise fashion, and (b) imagewise exposing the contacted donor and receptor sheets using a scanning exposure source, wherein either;

(i) the radiation-absorbing material is present in the receptor sheet, or (ii) the donor layer of the donor sheet comprises a layer of a vapor-deposited colourant and either the colourant itself is capable of absorbing the exposing radiation such that it will transfer unaided on exposure of the contacted sheets, or the radiation-absorbing material is present in an underlayer to the colourant layer.

The method of the invention utilises a scanning exposure source, such as a laser, to effect the thermal transfer of colourant from a donor sheet to a receptor sheet. "Colourant" is used herein in its broadest sense, as covering any material capable of modifying the surface of the receptor and regardless of whether the modification is visible to the naked eye.

In one aspect of the present invention, the radiation-absorbing material is incorporated in the receptor sheet. The inclusion of the radiation-absorbing material in the receptor sheet offers significant advantages over conventional thermal transfer materials, in which the radiation-absorbing material is present in the donor sheet, both in terms of higher resolution and greater sensitivity, since the heating effect is induced directly in the receptor. In a preferred embodiment, the receptor sheet includes a receptor layer for thermally transferred colourant, with the radiation-absorbing material contained in the receptor layer or, more preferably, in an ordinarily adjacent underlayer thereto.

Receptor sheets incorporating the radiation-absorbing material find use with donor sheets incorporating a wide range of thermally transferrable colourants, including dyes, pigments, waxes, resins etc. The colourant usually comprises one or more dyes or pigments either with or without an additional binder.

Colourants suitable for use in the present invention include (but not limited to, organic dyes and pigments), such as: indoanilines, amino-styryls, tricyanostyryls, methines, anthraquinones, oxazines, azines, diazines, thiazines, cyanines, merocyanines, phthalocyanines, indamines, triarylmethanes, benzylidenes, azos, monoazones, xanthenes, indigoids, oxonols, phenols, naphthols, pyrazolones etc., and inorganic pigments such as metals, metal oxides, metal sulphides etc., as disclosed in U.S. Pat. No. 5,437,912.

Thermal transfer donor sheets normally comprise a support bearing a layer of a thermally transferrable colourant, but may also comprise a self-supporting film of colourant in a polymeric binder, e.g., as disclosed in our copending European Patent Application No. 91311759.2, filed 18$^{th}$ Dec., 1991.

The donor sheets may be of the diffusion-transfer (sublimation-transfer) type, whereby colourant is transferred to the receptor sheet in an amount proportional to the intensity of the energy absorbed (giving a continuous tone image), but are preferably of the mass-transfer type, whereby essentially 0 (zero) or 100% transfer of colourant takes place depending on whether the absorbed energy exceeds a threshold value.

Mass-transfer donor sheets have several advantages, such as the provision of matched positive and negative images (on the donor and receptor sheet respectively), saturated colours, and the ability to image large areas with a uniform optical density, and are well-suited to half-tone imaging. However, poor resolution and high energy requirements have hampered their use in conventional thermal transfer imaging systems. The method of the invention is capable of producing mass-transfer images of unexpectedly high resolution and low energy requirement. Furthermore, it is surprisingly found that certain donor materials known to be diffusion-transfer type materials in the context of thermal printhead imaging, act as mass-transfer materials, when used in combination with a receptor sheet incorporating the radiation-absorbing material.

Mass-transfer materials typically comprise a support bearing a layer of dyes or pigments in a waxy binder, a typical example being TLP OHP-11 (commercially available from Mitsubishi). Alternative (and preferred) mass-transfer materials comprise a support bearing a, vapor-deposited colourant layer, preferably separated by a controlled release layer, as disclosed in U.S. patent applications Ser. Nos. 07/775782 and 07/776602, filed Oct. $11^{th}$, 1991. These donor sheets are found to give high resolution images with good colour saturation, high transparency and uniform optical density.

Another type of donor sheet highly suited to the present invention comprises a support bearing a thin layer of one or more dyes dissolved or dispersed in a binder. Preferably, the dyes form a eutectic mixture, as described in U.S. Pat. No. 4,857,503. Although this Patent describes such donor materials as being dye-diffusing (when imaged via a thermal printhead), it is surprisingly found that such materials act as mass-transfer materials in the context of the present invention, especially when very thin, layers (e.g., of less than 0.1 $\mu$m thickness) are employed. Once again, high resolution images are obtained The dye(s) are advantageously selected so as to match the proofing ink references provided by the International Prepress Proofing Association, known as the SWOP colour references. Examples of such dyes are disclosed in U.S. Pat. No. 5,024,990.

According to another aspect of the invention there is provided a thermal transfer medium comprising a donor sheet having a donor layer comprising a vapor-deposited thermally transferrable colourant or a layer of a sublimable colourant, preferably a sublimable dye, dispersed or dissolved in a binder, and a receptor sheet comprising a radiation-absorbing material. In a preferred embodiment, the donor sheet comprises a support bearing a layer of vapor-deposited colourant. The donor support may optionally have a controlled release layer (described hereinafter) onto which the colourant is vapor-deposited.

The radiation-absorbing material may be contained in a separate, dedicated layer (referred to herein as a "radiation-absorbing layer"), e.g., in an underlayer to the vapor-deposited colourant layer in the donor sheet or any receptor layer(s) in the receptor sheet. Alternatively, the radiation-absorbing material may be included in one of the other component layers of the donor or receptor sheets, e.g., the receptor layer of the receptor sheet. Where the colourant is itself radiation-absorbing such that it is to be regarded as the radiation-absorbing material, then no other radiation-absorbing material is required.

The radiation-absorbing material, ordinarily absorbing radiation in the wavelength region 600 to 1070 nm, more usually 750 to 980 nm, may comprise any suitable material able to absorb the radiant energy of the exposing source, convert it to heat energy and transfer that energy to the colourant in its immediate vicinity. Examples of suitable radiation-absorbing materials include pigments, such as carbon black, e.g., as disclosed in British Patent No. 2083726, and dyes, including (but not limited to): phthalocyanine dyes, e.g., as disclosed in U.S. Pat. No. 4,942,141; ferrous complexes, e.g., as disclosed in U.S. Pat. No. 4,912,083; squarylium dyes, e.g., as disclosed in U.S. Pat. No. 4,942,141; chalcogenopyrylo-arylidene dyes, e.g., as disclosed in U.S. Pat. No. 4,948,776; bis(chalcogenopyrylo) polymethine dyes, e.g., as disclosed in U.S. Pat. No. 4,948,777; oxyindolizine dyes, e.g., as disclosed in U.S. Pat. No. 4,948,778; bis(aminoaryl)polymethine dyes, e.g., as disclosed in U.S. Pat. No. 4,950,639; merocyanine dyes, e.g., as disclosed in U.S. Pat. No. 4,950,640; tetraarylpolymethine dyes; dyes derived from anthraquinones and naphthaquinones, e.g., as disclosed in U.S. Pat. No. 4,952,552; cyanine dyes, e.g., as disclosed in U.S. Pat. No. 4,973,572; trinuclear cyanine dyes, e.g., as disclosed in European Patent Publication No. 403933; oxonol dyes, e.g., as disclosed in European Patent Publication No. 403934; indene-bridged polymethine dyes, e.g., as disclosed in European Patent Publication No. 407744; nickel-dithiolene dye complexes, e.g., as disclosed in European Patent Publication No. 408908, and croconium dyes, e.g, as disclosed in our copending British Patent Application No. 9209047.1, filed $27^{th}$ Apr., 1992.

The radiation-absorbing material is preferably present in an amount and distribution sufficient so that absorption of the exposing radiation by the material will locally generate sufficient heat to enable transfer of the colourant from the donor sheet to the receptor sheet. The amount of radiation-absorbing material required for efficient colourant transfer will vary widely depending on the nature of the material used etc., but it is preferably present in an amount sufficient to provide a transmission optical density of at least 1.0 absorbance units, more preferably at least 1.5 absorbance units at the wavelength of the exposing radiation.

The radiation-absorbing layer ordinarily comprises a binder layer having dissolved or dispersed therein the radiation-absorbing material. Where applicable, the binder of the radiation-absorbing layer may comprise any of number of suitable materials including: poly(vinyl acetals), such as poly(vinyl formal) and poly(vinyl butyral); polycarbonates; poly(styrene-acrylonitrile); polysulfones; poly (phenylene oxide); poly(vinylidene chloride-vinyl acetate) copolymers, and mixtures thereof, although binder materials having a glass-transition temperature ($T_g$) of greater than 100° C. are preferred to ensure that the colourant adheres to the receptor sheet/layer and not the radiation-absorbing layer during thermal transfer.

When the radiation-absorbing layer comprises a mixture of dye or pigment and a binder, it is normally coated as a solution or dispersion in a suitable solvent, e.g., lower alcohols, ketones, esters, chlorinated hydrocarbons, and mixtures thereof. Any of the well-known solvent-coating techniques may be used, such as knife-coating, roller-coating, wire-wound bars etc. The thickness of the radiation-absorbing layer must be sufficient to provide the necessary optical density, and will depend on factors such as the extinction coefficient of the dye or pigment used, and its solubility in the binder. Relatively thin layers (e.g., up to 5 $\mu$m dry thickness) are preferred.

Alternatively, the radiation-absorbing layer may comprise a continuous layer of a solid, radiation-absorbing pigment or dye without a binder. A particularly suitable pigment in this context is "black aluminum oxide", which is a graded mixture of aluminium and aluminium oxide. Layers of these materials may be formed by vapor-depositing aluminium metal in the presence of controlled amounts of oxygen, as disclosed in U.S. Pat. Nos. 4,430,366 and 4,364,995. Very thin (<1 $\mu$m) coatings of this material show a high optical density over a wide wavelength range, covering the visible and infrared, which ensures compatibility with a wide range of exposure sources.

Receptor sheets for thermally transferred colourant normally comprises a support sheet having coated on at least one major surface thereof a receptor layer, ordinarily comprising a heat-softenable (low $T_g$), usually thermoplastic, binder, but when the radiation-absorbing material is present in the receptor layer, then the binder may require a higher $T_g$, typically 100° C. or greater. Ideally, the binder should soften during the imaging process to an extent that is sufficient to induce transfer of the colourant, but is not so great as to cause ablation, lateral flow or transfer to the donor sheet. This is more likely to be a problem when the radiation-absorbing material is present in the receptor layer. In these circumstances, the choice of binder is governed to a large extent by the nature of the donor sheet being used. For example, where the donor sheet comprises a layer of vapor-deposited dye or pigment, it is found that low $T_g$ receptor layers (containing the radiation-absorbing material) are unsuitable for the reasons outlined above, whereas high $T_g$ layers give good results. Conversely, low $T_g$ receptor layers (containing the radiation-absorbing material) work well with donor sheets comprising one or more dyes in a heat-softenable binder.

When the radiation-absorbing material is present in a separate underlayer, i.e., a layer interposed between the support and, ordinarily adjacent, the receptor layer, it is preferably coated in a high $T_g$ binder, typically having a $T_g$ of greater than 90° C., with the receptor (over)layer comprising a lower $T_g$ material having, e.g., a $T_g$ of from 40° to 90° C. Preferred high $T_g$ binders Include polyesters and polycarbonates, e.g., bisphenol-A-polycarbonate.

The receptor layer may comprise, e.g: a polycarbonate, a polyurethane, a polyester, a poly(vinyl chloride), poly (styrene-acrylonitrile), poly(ethylene-acrylic acid), poly (caprolactone), poly(vinylidene chloride-vinyl acetate) or a mixture thereof. The receptor layer may be present in any amount which is effective for the intended purpose.

Where the desired image is that transferred to the receptor sheet, then if the radiation-absorbing material is present in the receptor sheet, is is preferably colourless to the human eye or is photobleachable, so as to avoid "staining" the image. Where the final image is that remaining on the donor, or when the image on the receptor is subsequently transferred to a second receptor, such considerations are unimportant. Examples of radiation-absorbers with reduced staining properties include phthalocyanines (e.g., as disclosed in U.S. Pat. No. 4,788,128): nickel-dithiolene complexes (e.g., as disclosed in European Patent Publication No. 408908), and croconium dyes (e.g., as disclosed in our copending British Patent Application No. 9209047.1, filed 27$^{th}$ Apr., 1992.

Where the desired image is that transferred to the receptor sheet, then the receptor layer may, subsequent to imaging, be separable from the layer containing the radiation-absorbing material.

The support of the receptor sheet can be made of any material to which an image receptive layer can be adhered, including materials that are smooth or rough, transparent or opaque, flexible or rigid and continuous or sheetlike. The material should be able to withstand the heat required to transfer the colourant without decomposing or distortion. Of course at least one of the donor and receptor sheets must be transparent to the exposing radiation to allow for irradiation of the radiation-absorbing material, with the support material chosen accordingly. Suitable support materials are well known in the art, representative examples of which include (but are not limited to): polyesters, especially poly(ethylene terephthalate) and polytethylene naphthalate); polysulfones; polyolefins, such as poly(ethylene), poly(propylene) and poly(styrene); polycarbonates; polyimides; polyamides; cellulose esters, such as cellulose acetate and cellulose butyrate; poly(vinyl chloride), and derivatives thereof. A preferred support material is white-filled or transparent poly(ethylene terephthalate) or opaque paper. The support may also be reflective, such as baryta-coated paper, ivory paper, condenser paper, or synthetic paper. The support generally has a thickness of 0.05 to 5 mm, with 0.05 mm to 1 mm preferred.

The receptor (and where appropriate the donor) support may contain fillers, such as carbon black, titania, zinc oxide and dyes, and may be treated or coated with those materials generally used in the formation of films, such as coating aids, lubricants, antioxidants, ultraviolet radiation absorbers, surfactants, and catalysts.

In a further aspect of the present invention, the donor sheet comprises a layer of a vapor-deposited colourant and either the colourant itself constitutes the radiation-absorbing material such that it will transfer unaided on irradiation of the assembled donor and receptor sheets, or the donor sheet further comprises a radiation-absorbing material in a separate, ordinarily adjacent, underlayer to the colourant layer.

The use of a vapor-deposited colourant donor layer offers significant advantages over conventional thermal-transfer donor materials, in which the colourant is dissolved or dispersed in a binder, both in terms of higher resolution and greater sensitivity (speed). A vapor-deposited colourant is free from contamination by binder materials and produces a pure, more intense image on the receptor sheet. Also the transferred image shows a highly uniform optical density, even when large areas are transferred.

Colourants from any chemical class that may be vapor-deposited, i.e., which do not decompose upon heating, may be used. Preferred organic colourants include (but are not limited to): copper phthalocyanine and Pigment Yellow PY17 (commercially available from Sun Chemical Corporation) and Pigment Violet PV19 (commercially available from Ciba Geigy Corporation). Preferred inorganic colourants include (but are not limited to): metals, such as aluminium, copper, gold, silver etc., and metal oxides, especially "black aluminium oxide", as disclosed in U.S. Pat. Nos. 4,430,366 and 4,364,995, which gives a neutral black colour.

The vapor-deposited colourant layer is preferably coated at a sufficient thickness to provide a transmission optical density of at least 0.5 absorbance units, preferably at least 1.0 absorbance units. The thickness of the colourant layer depends upon the colourant used and the desired minimum optical density, but it can be as thin as a few tens of nanometers or as thick as several micrometers, e.g., 10 to 1000 nm thick, preferably 50 to 500 nm thick, and more preferably 100 to 400 nm thick. The colourant is typically pre-purified by sublimation prior to vapor-deposition.

Techniques for the vapor-deposition of colourant layers are well known in the art, and include resistive heating methods, radio frequency sputtering, plasma deposition, chemical vapor-deposition, epitaxy deposition and electron beam deposition methods. Specific examples may be found, e.g., in U.S. Pat. Nos. 4,430,366, 4,364,995, 4,587,198, 4,599,298 and 4,657,840, and U.S. patent application Ser. Nos. 07/775782 and 07/776602.

The colourant layer may be continuous or discontinuous, e.g., it may be deposited in the form of a pattern or in the form of alphanumeric characters by use of suitable masking techniques during the vapour deposition. Preferably, the colourant layer is continuous.

In many cases, it is found that the vapor-deposited colourant layer exhibits anisotropic cohesive forces. For example, it may possess a columnar microstructure (as disclosed in U.S. Pat. No. 5,139,598) in which the cohesive forces operating between the columns are substantially smaller than the cohesive forces acting within individual columns. Factors which are believed to affect the microstructure of the deposited layer include the substrate temperature, the deposition rate (which is a function of the evaporation source temperature, the source-to-substrate distance and the substrate temperature), the deposition angles, and the chamber pressure. (See, e.g: Debe and Poirier, "Effect of gravity on Copper Phthalocyanine Thin Films III: Microstructure Comparisons of Copper Phthalocyanine Thin Films Grown in Microgratrity and Unit Gravity", *Thin solid Films*, 186, pp.327 to 347 (1990); and Zurong et al., *Kexue Tongbao*, Vol. 29, p.280 (1984)). While an anisotropic microstructure is not essential in the practice of the present invention, it is highly preferred, as it is believed to contribute significantly to the resolution of the transferred image.

In the embodiment wherein the colourant layer itself is suitably radiation-absorbing such that a separate radiation-absorbing material is not required, the colourant layer is preferably vapor-deposited onto a controlled release layer present on the support of the donor sheet. Such a layer provides a controlled adhesion between the colourant and the support, such that the colourant transfers readily to the receptor sheet when required, but remains suitably abrasion resistant during normal handling.

Controlled release layers are particularly useful in the case of inorganic colourants, such as black aluminium oxide, which otherwise adhere too strongly to the most commonly used donor supports, and hence require inconveniently high irradiation intensities to effect transfer. Controlled release layers are described in detail in U.S. patent application Ser. Nos. 07/775782 and 07/776602, and may comprise, e.g., mixtures of two or more polymers that differ markedly in their affinity towards the donor support, or may comprise inorganic particles, such as boehmite (aluminium monohydrate) particles, hydrophobic silica particles, alumina particles, titania particles etc. The latter type of controlled release layer is preferred for use with inorganic colourants, and a particularly preferred controlled release layer for use with black aluminium oxide comprises a coating of boehmite particles, which are available as an aqueous dispersion under the trade name "CATAPAL D" from Vista Chemical Co., Houston, Tex., U.S.A. The former type of controlled release layer is preferred for use with organic colourants.

The support of the donor sheet ordinarily comprises a transparent substrate to allow for irradiation of the radiation-absorbing material by the exposure source. Examples of suitable support materials include (but are not limited to): polyether sulfones; polyimides, such as polyimide-amides and polyether imides; polycarbonates; polyacrylates; polysulfones; cellulose esters, such as ethyl cellulose, cellulose acetate, cellulose acetate hydrogen phthalate, cellulose acetate butyrate, cellulose acetate propionate, cellulose triacetate etc.; poly(vinyl alcohol-vinyl acetal) copolymers; polyesters, such as poly(ethylene terephthalate) which may be biaxially stabilized and poly(ethylene naphthalate); fluorinated polymers, such as poly(vinylidene fluoride) and poly(tetrafluoroethylenehexafluoropropylene); polyvinyl resins, such as poly(vinyl acetate), poly(vinyl chloride); polyethers, such as poly(oxyethylene); polyacetals, such as poly(vinyl butyral) and poly(vinyl formal); polyolefins, such as poly(ethylene), poly(propylene) and poly(styrene), and polyamides. However, where the assembled donor and receptor sheets are exposed through the receptor sheet, then the support material of the receptor may be opaque, contain fillers etc., considerations of transparency being unimportant. The donor support may be flexible or rigid, although the former is preferred, and continuous or sheet-like.

According to a further aspect of the present invention, there is provided a thermal transfer donor sheet comprising (sequentially): a support; a radiation-absorbing layer comprising a dye or the combination of a pigment and a binder, and a layer of a vapor-deposited thermally transferable colourant.

In use, the thermal transfer donor sheet is combined with a receptor sheet and irradiated by radiation of an appropriate wavelength for the radiation-absorbing layer. In the exposed regions of the assembled donor and receptor sheets, the radiation-absorbing layer converts the radiant energy of the exposure source to thermal energy and transfers the heat to the colourant causing the transfer of colourant to the receptor sheet in an imagewise fashion.

The receptor sheet usually comprises a support having coated on at least one major surface thereof a receptor layer, ordinarily comprising a heat-softenable (i.e., $T_g$<100° C.), usually thermoplastic, binder—although any suitable receptor for thermally transferred colourant may be used.

Any suitable scanning exposure source may be used to effect the thermal transfer of the colourant from the donor sheet to the receptor sheet, although the preferred exposure source is a laser, with the exposure source and radiation-absorbing material selected such that the output radiation closely matches the wavelength of maximum absorption of the radiation-absorbing material, in order to make effective use of the available energy.

Several different kinds of laser may be used to effect thermal transfer of colourant, including (but not limited to): gas ion lasers, such as argon and krypton lasers; metal vapor lasers, such as copper, gold and cadmium lasers; solid state lasers, such as ruby or YAG lasers, and diode lasers, such as gallium arsenide lasers, but in practice, laser diodes which offer substantial advantages in terms of their small size, low cost, stability, reliability, ruggedness and ease of modulation in accordance with digitally stored information, are preferred. Generally, exposure sources emitting in the infrared region of from 750 to 980 nm are preferred, although any source emitting radiation in the region 600 to 1070 nm may be usefully employed in the practice of the invention.

In one method, the laser is scanned directly over the assenbled donor and receptor sheets, while its intensity is modulated in accordance with digitally stored image information. This method is disclosed in, for example: Japanese Patent No. 51-088016, U.S. Pat. No. 4,973,572, British Patent No. 1433025, and British Patent Publication No. 2083726, and provides a very good resolution.

Another method of imaging comprises:

(a) assembling the donor and receptor sheets so that the donor layer of the donor sheet is in intimate contact with the receptor sheet;

(b) contacting a photographic mask with the assembled donor-receptor sheets, and (c) exposing the assembled donor and receptor through the photographic mask using a scanning, preferably continuous, exposure source so that in areas defined by the transparent regions of the mask, the exposing radiation is absorbed and converted to thermal energy by the radiation-absorbing material to effect thermal transfer of colourant from the donor sheet to the receptor sheet.

By suitable adjustment of the various parameters, such as laser power, spot size, scan rate and focus position, it is possible to effect thermal transfer imaging without damaging the photographic mask. This is due to the fact that only a small area of the mask is irradiated at any one instant, with the remainder available to act as a heat sink. The optimum exposure parameters depend on a number of variables, such as the sensitivity of the thermal transfer media and the thermal conductivity of both the mask and the radiation-absorber. The mask preferably has a thermal conductivity of at least $2\times10^{-3}Wcm^{-1}\cdot K^{-1}$. The assembled donor and receptor sheets preferably constitute a system of sufficient sensitivity to allow the thermal transfer of colourant at energy levels of less than $4J/cm^2$.

Where the colourant layer is present in the donor sheet as a discontinuous layer, e.g., as a pattern or as alphanumeric characters, simple illumination with a continuous, scanning laser is sufficient without the need of a mask.

Whichever method of address is used, the laser preferably has a power of at least 5 mW, with the upper power limit depending on the characteristics of the mask (if used) and the thermal transfer media, as well as the scan speed and spot size. The laser is focused on the radiation-absorbing layer to give an illuminated spot of small, but finite dimensions, which is scanned over the entire area to be imaged. Exposure of the assembled donor and receptor sheets may be carried out from either side, i.e., through the support of the donor sheet, or through the support of the receptor sheet, providing of course that all layers through which the radiation must pass before reaching the radiation-absorbing material are suitably transparent. In the case of exposure through a mask, the laser output may be adjusted via a cylindrical lens to a narrow line, the longer dimension of which is perpendicular to the direction of scan, thereby permitting a larger area to be scanned in one pass. Scanning of the laser may be carried out by any of the known methods, but will normally involve raster scanning, with successive scans abutting or overlapping as desired. Two or more lasers may scan different areas of a large image simultaneously.

To ensure good resolution and effective image transfer, it is essential that the donor and receptor sheets and the mask (if used) are held in intimate contact with each other during imaging. This is achieved by subjecting the assembly of mask (if used) and donor and receptor sheets to pressure, ordinarily of at least $10\ g/mm^2$, preferably at least $40\ g/mm^2$ and typically about $100\ g/mm^2$.

Multicolour images may be produced by repeating the above described imaging methods with successive donor sheets of different colours, using the same receptor in each case.

If desired, the final image may be transferred from the original receptor to another substrate, such as paper or card stock. This transfer may be carried out by conventional thermal lamination techniques, as disclosed in, e.g., European Patent Publication No. 454083. If the receptor support is transparent, then radiation-induced transfer is also possible.

The present invention will now be described with reference to the accompanying, non-limiting Examples in which the following resins are used as binder materials for the various layers of the donor/receptor sheets.

BIS A is bisphenol-A-polycarbonate of the formula:

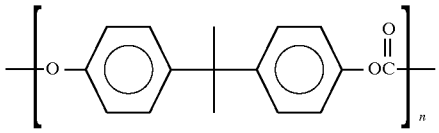

having a glass-transition temperature ($T_g$) of 160° C.—commercially available from Polysciences Inc.

CAB 381-20 is cellulose acetate butyrate having a $T_g$ of 138° C.—commercially available from Eastman Kodak.

CAB 500 is cellulose acetate butyrate having a $T_g$ of 96° C.—commercially available from Eastern Kodak.

VINYLITE VYNS is a poly(vinylidene chloride-vinyl acetate) copolymer having a $T_g$ of 79° C.—commercially available from Union Carbide.

BUTVAR B-76 is a poly(vinyl butyral) resin having a $T_g$ of 56° C.—commercially available from Monsanto.

EXAMPLE 1

This Example demonstrates how a scanning exposure source, such as a laser, can be used to effect thermal transfer of colourant from a donor sheet to a receptor sheet comprising a support bearing a receptor layer for thermally transferred colourant, the receptor sheet further comprising a radiation-absorbing material in either the receptor layer (Receptor Sheets 1 to 3) or in a separate underlayer interposed between the support and receptor layer (Receptor Sheets 4 to 7).

Receptor Sheets 1 to 7 were prepared as follows:

Receptor Sheet 1

Support: poly(ethylene terephthalate) polyester (100 μm thick)

Receptor Layer: a solution of VINYLITE VYNS (1.5 g) and IR-Dye I(0.05 g) dissolved in a mixture (10 g) of methylethylketone and toluene (1:1) was coated onto the support at a wet thickness of 37.5 μm.

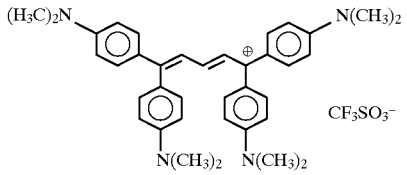

IR-Dye I

Receptor Sheet 2

Support: as per Receptor Sheet 1.

Receptor layer: a solution of CAB 500 (1 g) and IR-Dye I (0.05 g) dissolved in a mixture (10 g) of methylethylketone and toluene (1:1).

Receptor Sheet 3

Support: as per Receptor Sheet 1.

Receptor layer: a solution of BIS A (3 g) and IR-Dye I (0.1 g) dissolved in a mixture (30 g) of cyclohexanone and dichloromethane (3:2).

Receptor Sheet 4

Support: as per Receptor Sheet 1.

IR-absorbing layer: a mixture of BIS A (6.7 g) and IR-Dye 1 (0.05 g) in dichloromethane (53.2 g) and cyclohexanone (6.7 g) was coated onto the support at a wet thickness of 25 μm.

Receptor layer: a solution of BUTVAR B-76 (1 g) in a mixture (10 g) of methylethylketone and methanol (1:1) was coated at Kbar 1 onto the dried IR-absorbing layer. "Kbars" are wire wound coating rods, commercially available from R.K. Print Coat Instruments Ltd.

Receptor Sheet 5

Support: as per Receptor Sheet 1.

IR-absorbing layer: as per Receptor Element 4.

Receptor layer: a solution of VINYLITE VYNS (1.5 g) dissolved in a mixture (10 g) of methylethylketone and toluene (1:1) was coated at Kbar 1 onto the dried IR-absorbing layer.

Receptor Sheet 6

Support: as per Receptor Sheet 1.

IR-absorbing layer: as per Receptor Element 4.

Receptor layer: a solution of CAB 500(1 g) dissolved in a mixture (10 g) of methylethylketone and methanol (1:1) was coated at Kbar 1 onto the dried IR-absorbing layer.

Receptor Sheet 7

Support: as per Receptor Sheet 1

IR-absorbing layer: as per Receptor Element 4.

Receptor layer: a solution of CAB 381-20 (1 g) dissolved in a mixture (10 g) of methylethylketone and methanol (1:1) was coated at Kbar 1 onto the dried IR-absorbing layer.

A sample of each of Receptor Sheets 1 to 7 was placed in face-to-face contact with one or more of the following donor sheets, with the donor layer of the donor sheet in intimate contact with the receptor layer of the receptor sheet.

Donor Sheet A

A wax thermal transfer medium commercially available from Mitsubishi under the trade name TLP OHP11.

Donor Sheet B

Support: poly(ethylene terephthalate) polyester base (100 μm thick).

Donor layer: a copper phthalocyanine pigment commercially available from Sun chemicals Inc., was purified by vacuum sublimation at 500° C. and 200 $Nm^{-2}$ (1.5 Torr) (argon) pressure. The purified pigment was loaded in a heater made from stainless steel sheet material and the heater positioned in a custom built 30 cm bell jar vacuum coater equipped with a diffusion pump and a 15 cm web drive, about 4 cm below the web. The support was fed onto the web drive before pumping the vacuum chamber down to $6.7\times10^{-3}Nm^{-2}$ ($5\times10^{-5}$Torr) pressure. The heater was heated to 410° C. using an applied a.c. power supply to vaporize and deposit the pigment onto the support, the web drive moving at a speed of 0.25 cm per second.

Donor Sheet C

Support: poly(ethylene terephthalate) polyester base (100 μm thick).

Donor layer: Magenta Dye I (0.2 g) and a dispersant (0.3 g; commercially available from Troy Chemicals under the trade name CDI) were added to a solution of CAB 381-20 (0.8 g) in methylethylketone (30 g) and methanol (20 g). The resulting mixture was coated onto the support at Kbar 0 to produce a magenta coating (0.05 μm dry thickness) having a transmission optical, density of 0.6 absorbance units at 530 nm. The coating was air dried at 30° C. for six hours.

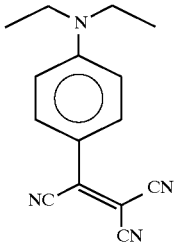

Magenta Dye I

Each of the contacted donor and receptor sheets was overlaid with a UGRA line dot scale mask and addressed with a laser diode emitting at 830 nm using the imaging assembly described hereinafter with reference to FIG. 1.

The assembled donor and receptor sheets (with mask) are sandwiched between a transparent pressure plate (2) and a support roller (4) biased against the plate (2) by a suitable weight (6) acting through pivot (8). A mirror (10) and focusing lens (12) mounted on a support (14) are provided to focus the beam (16) from a laser diode (18) onto the IR-absorbing layer of the receptor sheet at the point of maximum pressure provided by the support roller (4). A linear stepped motor drive (20) advances the support (14) along slides (22). The assembly of donor and receptor sheets was imaged at a power level sufficient to produce maximum effect on the donor sheet, but with minimum IR-induced heating in the UGRA half-tone mask. The operating conditions were as follows: laser power 10 mW, spot size 20 μm, scan rate 1.5 cm per second and a contact pressure (between support roller (4) and pressure plate (2)) in excess of 50 $gmm^{-2}$. This method of contact exposing imaging materials via half-tone masks with monochromatic radiation is disclosed in EP 0583165. After exposure, each composite was separated and the percentage (%) dot transfer and the resolved dot range estimated at a resolution of 60 lines per cm. The results are shown in TABLE 1.

TABLE 1

| Assembly | Receptor Sheet | Donor Sheet | Dot Transfer (%) | Resolved Dot Range |
|---|---|---|---|---|
| 1 | 1 | B | 0 | — |
| 2 | 2 | | 0 | — |
| 3 | 3 | | 100 | 97/3 |
| 4 | 4 | | 100 | 97/3 |
| 5 | 5 | | 100 | 97/3 |
| 6 | 6 | | 0 | — |
| 7 | 7 | | 0 | — |
| 8 | 4 | A | 100 | 95/5 |
| 9 | 5 | | 100 | 95/5 |
| 10 | 6 | | patchy | — |
| 11 | 7 | | patchy | — |
| 12 | 5 | C | 100 | 97/3 |
| 13 | 4 | | 100 | 97/3 |
| 14 | 6 | | 0 | — |
| 15 | 7 | | 0 | — |

Assemblies 1 to 3: demonstrate that, where the donor sheet comprises a vapor-deposited colourant layer and the radiation-absorbing material is present in the receptor layer of the receptor sheet, then the binder for the latter should desirably have a high glass-transition temperature ($T_g$) typically greater than 100° C. The use of lower $T_g$ materials, such as VINYLITE VYNS and CAB 500, results in much binder flow and possible ablation, such that mass transfer from the donor sheet is prevented.

Assemblies 4 to 11: demonstrate that the provision of the radiation-absorbing material in an underlayer to the receptor layer permits mass transfer from the donor sheet to the receptor sheet in a clean (100% transfer) manner. The best results were obtained from binders having a $T_g$ of from 40 to 90° C., as materials, such as CAB 381-20 and CAB 500, having a $T_g$ greater than 90° C. do not melt/soften sufficiently to allow mass transfer.

Assemblies 12 to 15: demonstrate that thin donor layers comprising a dye in a thermoplastic binder give high-resolution mass transfer images by means of the present invention. With the radiation-absorbing material in an underlayer, best results were obtained with low $T_g$ receptor layers.

EXAMPLE 2

This Example demonstrates the use as donor materials of very thin layers comprising a mixture of dyes in a binder.

An IR-absorbing receptor was prepared by coating a support (polyester; 100 μm) with a solution comprising IR-Dye I (0.25 g), VINYLITE VYNS (2.5 g), methylethylketone (25 g) and toluene (25 g). The solution was tumble-mixed for 24 hours before coating at 62.5 μm wet thickness. The dried coating had a transmission optical density of 1.5 absorbance units at 820 nm.

Two magenta donor sheets were prepared by coating a polyester support (100 μm) with a solution containing CAB 381-20 (0.8 g), methylethylketone (25 g), cyclohexanone (5 g), methanol (20 g), CDI (0.3 g), magenta Dye II (0.3 g) and magenta Dye III (1.2 g). The first sheet was coated at 4 μm wet thickness (Kbar 0), and the second at 24 μm wet thickness (Kbar 3). The dry thickness of the thinner coating was measured (by scanning electron microscopy) to be 0.033 μm.

The donor sheets were assembled, in turn, in face-to-face contact with samples of the receptor and imaged as described in Example 1, using a laser power of 20 mW, a scan rate of 5 cm per second and a pressure of 20 g/mm$^2$. High resolution mass transfer was observed using the first donor sheet, with clean transfer of 97–3% dots (60 lines/cm screen). The second (thicker) donor resolved only the 80–20% dots.

Magenta Dye (II)

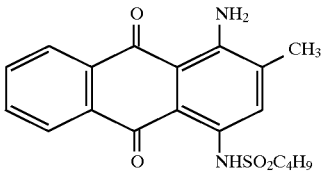

Magenta Dye (III)

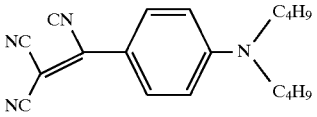

EXAMPLE 3

This Example demonstrates the generation of a three-colour image using the thermal transfer imaging method of the invention.

Separate yellow, magenta and cyan donor sheets were prepared as described in Example 2, except that in the coating solutions for the cyan and yellow layers, the magenta dyes were replaced by cyan Dyes I to III (0.4 g of each) or yellow Dyes I to III (0.3 g, 0.3 g and 0.5 g respectively) as appropriate.

A sample of the receptor sheet of Example 2 was assembled in face-to-face contact with a sample of the magenta donor sheet, and a colour separation mask corresponding to magenta image information placed on top of the donor sheet. The entire assembly of mask and donor and receptor sheets was subjected to 50 g/mm$^2$ pressure and irradiated (from the mask side) by a scanned laser diode as described in Example 1. The laser power was 40 mW and the scan speed 5 cm per second. A negative magenta image was formed on the receptor sheet, with a matched positive image remaining on the donor sheet.

Using the same receptor sheet, the process was repeated with the cyan and yellow donor sheets (and appropriate colour separation masks) to build up a three-colour image on the receptor sheet. This image could then be transferred to paper stock by assembling the image-bearing receptor sheet face down on the paper under pressure and scanning with the laser diode through the receptor support. A laser power of 20 mW and a scan rate of 5 cm per second were used.

Cyan Dye I

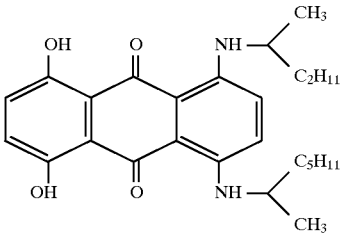

-continued

Cyan Dye II

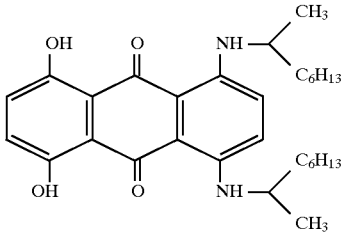

Cyan Dye III

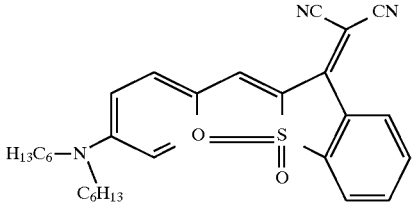

Yellow Dye I

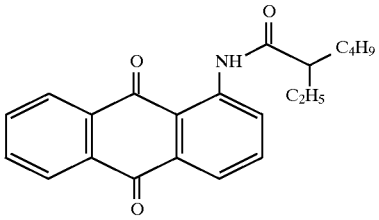

Yellow Dye II

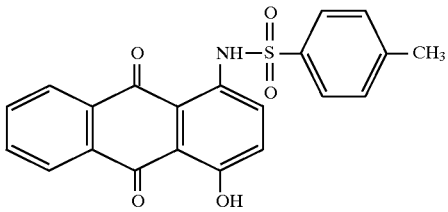

Yellow Dye III

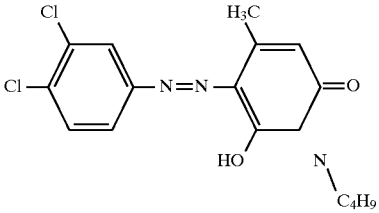

Cyan dye (III) is commercially available under the trade name FORON BRILLIANT BLUE S-R Yellow dye (III) is commercially available from Nippon Kayaku under the trade name MQ-452.

EXAMPLE 4

This Example demonstrates how a scanning exposure source corn be used to effect thermal transfer from a donor sheet comprising a layer of a vapor-deposited colourant wherein either the colourant is capable of absorbing the exposing radiation (Donor Sheet F) or a separate radiation-absorbing material is present in an underlayer adjacent the colourant layer (Donor Sheets D, E and G).

Donor Sheets D to G were prepared as follows:

Donor Sheet D

Support: polytethylene terephthalate) polyester base (100 $\mu$m thick).

IR-absorbing layer: IR-Dye I (0.05 g) was added to Bis-A (3.3 g) in dichloromethane (26 g) and cyclohexanone (3.3 g) and the resulting mixture tumble-stirred for 24 hours. The mixture was coated at 37.5 $\mu$m wet thickness onto the support and dried at room temperature. Care was taken to ensure that dust particles did not deposit on the coating. The transmission optical density of the IR-absorbing layer was measured as 1.2 absorbance units at 830 nm.

Colourant layer: as per donor layer of Donor Sheet B of Example 1.

Donor Sheet E

Support: as per Donor Sheet D.

IR-absorbing layer: as per Donor Sheet D.

Colourant layer: violet pigment PV19—commercially available from Ciba Geigy, was purified by vacuum sublimation at 475° C. and 2.7Nm$^{-2}$ (20 mTorr) pressure as detailed above. The purified pigment was vapor-deposited onto the coated support under virtually identical deposition conditions but using a heater temperature of 400° C.

Donor Sheet F

Support: poly(ethylene terephthalate) polyester base (75 μm thick).

IR-absorbing/colourant layer: a boehmite (Al0.0H) subbing layer (0.4% by weight CATAPAL D, commercially available from Vista Chemical Co.; 10 μm wet thickness) was coated onto the support, dried at 80° C. and overcoated with a vapor-deposited layer of "black aluminium oxide" (approximately 0.15 μm thick) following the procedure described in U.S. Pat. Nos. 4,364,995 and 4,430,366. The transmission optical density of the layer was determined to be at least 4.6 absorbance units.

Donor Sheet G

Support: as per Donor Sheet F.

IR-absorbing layer: as per Donor Sheet F.

Colourant layer: as per Donor Sheet D.

A sample of each of Donor Sheets D to G was placed in face-to-face contact with Receptor Sheets 8 and 9 (see below), with the donor layer of the donor sheet in intimate contact with the receptor layer of the receptor sheet.

Receptor Sheet 8

Support: paper base.

Receptor layer: a layer (1.5 μm thick) of a poly(ethylene-acrylic acid) emulsion ($T_g$=34° C.; commercially available from Schering) was coated on to the support.

Receptor Sheet 9

Support: poly(ethylene terephthalate) polyester (100 μm thick).

Receptor layer: a layer (1.5 μm thick) of a poly(vinylidene chloride-vinyl acetate) resin ($T_g$=79° C.; commercially available from Union Carbide under the trade name VINYLITE VYNS) was coated onto the support.

Each of the contacted donor and receptor sheets was overlaid with a UGRA line dot scale mask and imaged as described in Example 1, but using the following operating conditions: laser energy 10 mW, spot size 10 μm, scan rate 1.5 cm per second and a contact pressure (between support roller and pressure plate) of 50 gmm$^{-2}$. After exposure, the donor and receptor sheets were separated and the percentage (%) dot transfer and the resolved dot range estimated at a resolution of 60 lines per cm. The results are shown in TABLE 2.

TABLE 2

| | Receptor Sheet | | | |
|---|---|---|---|---|
| | 8 | | 9 | |
| Donor Sheet | Dot Transfer (%) | Resolved Dot Range | Dot Transfer (%) | Resolved Dot Range |
| D | 100 | 95/5 | 100 | 97/3 |
| E | 100 | 95/5 | 100 | 97/3 |

TABLE 2-continued

| | Receptor Sheet | | | |
|---|---|---|---|---|
| | 8 | | 9 | |
| Donor Sheet | Dot Transfer (%) | Resolved Dot Range | Dot Transfer (%) | Resolved Dot Range |
| F | 100 | 97/3 | patchy* | — |
| G | 100 | — | 100 | — |

*The receptor layer (VINYLITE VYNS) tended to lose adhesion to the support and adhere to the black aluminium oxide donor layer of the donor sheet.

The degree of dot transfer was, in the majority of cases, excellent (100% transfer) with good resolution, yielding matched positive and negative images on the donor and receptor sheet, respectively. The images were also characterised by a high uniformity of optical density over large areas.

GLOSSARY

"VINYLITE VYNS" (Union Carbide), "CATAPAL D" (Vista Chemical Co.), "PY17" and "PV19" (Ciba Geigy), "BUTVAR" (Monsanto), "CAB" (Eastman Kodak), "BIS A" (Polysciences), "TLP OHP11" (Mitsubishi), "MQ-452" (Nippon Kayaku), and "FORON BRILLIANT BLUE" are all trade names/designations.

We claim:

1. A method comprising the following steps:

(a) creating a thermal transfer donor sheet by vapor depositing a colorant layer onto a support;

(b) contacting a receptor sheet with the donor sheet such that the colorant layer is in intimate contact with the receptor sheet, wherein at least one of the donor and receptor sheets comprises a radiation-absorbing material;

(b) imagewise exposing the contacted sheets to radiation of a wavelength absorbed by the radiation-absorbing material, thereby causing heating in the exposed regions, said heating causing thermal transfer of colorant from the donor sheet to the receptor sheet in an imagewise fashion.

2. The method of claim 1 wherein the receptor comprises a support having coated thereon a receptor layer for the colorant and the radiation-absorbing material is present in either the receptor layer or a layer between the support and the receptor layer.

3. The method of claim 1 in which the donor sheet comprises a support bearing a controlled release layer onto which the colorant layer is vapor deposited.

4. The method of claim 1 in which the donor sheet comprises a support, a radiation-absorbing layer on the support and the vapor deposited colorant layer over the radiation-absorbing layer.

5. The method of claim 1 in which the vapor deposited colorant layer has anisotropic cohesive forces.

6. The method of claim 1 in which the vapor deposited colorant layer has a columnar microstructure.

7. The method of claim 1 in which the radiation absorbing material is present in a separate layer which farther comprises a binder.

8. The method of claim 1 in which the radiation-absorbing material absorbs radiation having a wavelength of from 600 to 1070 nm.

9. The method of claim 1 in which the radiation source is a scanning exposure source.

10. The method of claim 1 further comprising assembling a mask in intimate contact with the contacted donor and receptor sheets and exposing the assembly to radiation through the mask, the exposing radiation causing thermal transfer of colorant from the donor sheet to the receptor sheet in areas defined by transparent regions of the mask.

11. The method of claim 1 in which the radiation absorbing material is in the colorant layer of the donor sheet.

12. The method of claim 1 wherein the colorant is selected from organic pigments and inorganic colorants.

* * * * *